US006071113A

United States Patent [19]

Tsubouchi et al.

[11] Patent Number: 6,071,113

[45] **Date of Patent: *Jun. 6, 2000**

[54] CATALYTIC COMBUSTION ELEMENT AND METHOD OF CAUSING CATALYTIC COMBUSTION

[75] Inventors: Osamu Tsubouchi, Chiryu; Masayasu Andou, Anjo; Susumu Yamaguchi, Okazaki, all of Japan

[73] Assignee: Aisin Seiki Kabushiki Kaisha, Kariya, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/889,365

[22] Filed: Jul. 8, 1997

[30] Foreign Application Priority Data

Jul. 8, 1996 [JP] Japan ..... 8-177921

[51] Int. Cl.[7] ..... F23B 5/20; F23D 3/40

[52] U.S. Cl. ..... 431/7; 431/328; 431/329; 431/354; 431/170; 60/723; 502/527.19

[58] Field of Search ..... 431/7, 326, 328, 431/329, 170, 278, 350, 354, 249, 207, 268, 147, 347; 422/177; 502/527, 527.11, 527.19, 527.2; 60/723; 126/91 A

[56] References Cited

U.S. PATENT DOCUMENTS

| | | | |
|---|---|---|---|
| 2,362,972 | 11/1944 | Brownback | 431/347 |
| 2,627,306 | 2/1953 | Stadd et al. | 431/326 |
| 3,057,400 | 10/1962 | Wagner | 431/329 |
| 3,216,478 | 11/1965 | Saunder et al. | 431/329 |
| 3,310,098 | 3/1967 | Hardison | 431/329 |
| 3,697,447 | 10/1972 | Bettinardi | 431/328 |
| 4,154,568 | 5/1979 | Kendall et al. | 431/7 |
| 4,588,373 | 5/1986 | Tonon et al. | 431/328 |
| 4,870,824 | 10/1989 | Young et al. | 431/328 |
| 4,927,353 | 5/1990 | Nomura et al. | 431/328 |
| 5,026,273 | 6/1991 | Cornelison | 431/329 |
| 5,248,251 | 9/1993 | Dalla Betta et al. | 431/7 |
| 5,263,998 | 11/1993 | Mackrodt et al. | 431/7 |
| 5,368,475 | 11/1994 | Suppiah et al. | 431/268 |
| 5,421,719 | 6/1995 | Saito et al. | 431/7 |
| 5,511,974 | 4/1996 | Gordon et al. | 431/329 |
| 5,518,697 | 5/1996 | Dalla Betta et al. | 431/7 |
| 5,746,194 | 5/1998 | Legutko | 431/326 |
| 5,749,721 | 5/1998 | Klinge et al. | 431/328 |

FOREIGN PATENT DOCUMENTS

| | | |
|---|---|---|
| 1-247902 | 10/1989 | Japan . |
| 3-140705 | 6/1991 | Japan . |
| 5-79613 | 3/1993 | Japan . |

OTHER PUBLICATIONS

Heat Transfer; Bejan, Adrian, John Wiley & Sons; New York, pp. 620 and 632, 1993.

*Primary Examiner*—Ira S. Lazarus
*Assistant Examiner*—Josiah C. Cocks
*Attorney, Agent, or Firm*—Oblon, Spivak, McClelland, Maier & Neustadt, P.C.

[57] ABSTRACT

An efficient, high output, compact catalytic combustor that is low in combustion cost includes a combustion member having a front surface portion and a rear surface portion. The air-fuel mixture passing from the rear surface portion toward the front surface portion is combusted on the front surface portion. The combustion member is made of a material higher in thermal conductivity than alumina and includes a flame-holding unit for geometrically holding the flames formed on the surface of the combustion member. A catalyst oxide is carried on at least the front surface portion of the combustion member.

6 Claims, 7 Drawing Sheets

CATALYTIC COMBUSTION ELEMENT AND METHOD OF CAUSING CATALYTIC COMBUSTION

INCORPORATION BY REFERENCE

The entire disclosure of Japanese Patent Application No. 08-177921 filed on Jul. 8, 1996 including specification, drawings, and abstract is incorporated herein by reference in its entirety.

BACKGROUND OF THE INVENTION

1. Field of the Invention

The present invention relates to a catalytic combustion element and a method of causing catalytic combustion.

2. Discussion of the Related Art

In Japanese Patent Laid-Open No. Hei 3-140705, there is disclosed a conventionally employed catalytic combustion element, which will be described with reference to FIG. 9. When a valve 21 is closed, a fan 22 is driven to supply air from a tubular passage 23*a* of an air supply tube 23, and fuel is supplied through a fuel supply tube 24. The air and fuel thus supplied collide with a rectifying plate 26 arranged inside a mixing chamber 25, are mixed uniformly with each other therein and are blown out from flame holes 27*a* formed in a combustion plate 27. Then the air-fuel mixture is ignited by an ignition unit 28 so that flames 29 are generated. The flames 29 heat a catalyst 30 which is arranged at the left end of a combustion cylinder shown in the figure. The temperature of the catalyst 30 is detected by a temperature sensor 31. When a temperature at which catalytic combustion can occur is reached, the valve 21 is opened to supply air from a tubular passage 23*b*. Then the flames 29 formed at the combustion plate 27 are blown off and transferred to the catalyst 30. Since the catalyst 30 has already reached a catalytic activation temperature, catalytic combustion is started immediately. The catalyst 30 can be employed in a variety of heating burners.

In Japanese Patent Laid-Open No. Hei 5-79613, there is disclosed another combustion apparatus which will be described with reference to FIG. 10. In this apparatus, a mixing chamber 44 is supplied with fuel and air from a fuel supply tube 41 and an air supply tube 42 respectively. The air is heated by a heater 43 before being supplied to the mixing chamber 44, so that a catalyst 45 in a first stage is heated. When the catalyst 45 in the first stage reaches a catalytic activation temperature, the air-fuel mixture is supplied through an air-fuel mixture supply tube 46, thereby heating a catalyst 47 in a second stage. When the catalyst 47 in the second stage reaches a catalytic activation temperature, the air-fuel mixture is supplied through an air-fuel mixture supply tube 48, thereby heating a catalyst 49 in a third stage. When the catalyst 49 in the third stage reaches a catalytic activation temperature, catalytic combustion is started. As a result, combustion gas 50 is dissipated outside to heat an object to be heated.

The conventional technologies described above pertain to a catalytic combustion element wherein a catalyst is arranged inside a combustor. In case of a catalytic combustion system having a catalyst carried on the front surface of a combustor, when combustion occurs on the front surface of the combustor, flames generated remain as they are without being blown off. It is essential for this type of combustor to hold the flames in position for combustion stability as well as easily controllable operations.

However, the conventionally employed catalytic combustor generally has the following disadvantages. First, the combustor is mostly made of a material such as cordierite or alumina so that the catalyst can be easily carried on the front surface thereof. These materials, however, have such a low thermal conductivity that the heat is liable to be retained in the combustor during combustion. In other words, a substantially adiabatic state occurs. According to FIG. 11, which illustrates the relation between excess air and combustion temperature, it may be understood that when the excess air factor is unity, the highest heat efficiency as well as the highest temperature is obtained. The excess air factor represents the excessive air in the air-fuel mixture, and when the excess air factor is unity the stoichiometric air-fuel ratio is achieved. For example, if the excess air factor is 2, there is twice as much air as contained in the air-fuel mixture at the stoichiometric air-fuel ratio. Therefore, it is desirable for combustion to set the excess air factor within the range of 1 to 1.2. However, if a burner is made of a material having low thermal conductivity as in the conventional technology, the temperature of flames in the adiabatic thermal equilibrium state reaches an undesirably high temperature of up to 1900° C. At this high temperature, the catalyst oxide is no longer resistant to heat, and a material such as cordierite is no longer resistant to thermal shock. Accordingly, although an excess air factor within the range of 1 to 1.2 is desirable in principle, in practice, it is unavoidable to use a relatively lean air-fuel mixture whose excess air factor is 3. Thus, a comparatively bulky air supply blower that is able to supply a great amount of air is required, which results in an increase in the overall dimensions of the apparatus as well as a decrease in heat efficiency.

If the combustor did not have a catalyst carried thereon, the above-mentioned problem would be solved. In this case, however, it would solely depend on the geometry of the combustor whether the flames generated in gas-phase combustion are held appropriately. Since the flames are held less effectively by the geometry of the combustor than by a catalyst, even a slight increase in fuel supply would cause difficulties in holding the flames. That is, the flames would tend to be separated from the combustor. Consequently, in order to hold the flames effectively, the amount of fuel supply cannot be increased beyond a certain limit. Thus, it is impossible to produce an output higher than a certain limit.

Furthermore, the conventionally employed catalytic combustor requires the temperature of a catalytic layer carrying the catalyst to be always maintained equal to or higher than the catalytic activation temperature. It is necessary, therefore, to heat the air-fuel mixture all the time, which leads to a significant increase in the cost of combustion.

SUMMARY OF THE INVENTION

The present invention, which has been developed in view of the above-mentioned circumstances, has as an object to provide a highly efficient, comparatively small catalytic combustion element that allows high outputs to be produced and the combustion cost to be lowered.

In order to achieve the above-mentioned object, according to a first aspect of the present invention, there is provided a catalytic combustion element comprising a combustion member having front and rear surface portions and made of a material higher in thermal conductivity than alumina. The combustion member includes flame-holding means and has an oxidation catalyst carried at least on the front surface portion thereof The combustion member allows air-fuel mixture to pass from the rear surface portion to the front surface portion so that the air-fuel mixture can burn on the front surface portion. The flame-holding means is geometrically configured such that flames formed on the front surface portion of the combustion member can be held.

The thermal conductivity of the combustion member used in the present invention is not less than that of alumina, that is, about 0.004 cal/cm sec. ° C. For example, the combustion member may be made of a ceramic material including SiC, which has a comparatively high thermal conductivity of 0.1 cal/cm sec. ° C.

According to a second aspect of the present invention, the catalytic combustion element selectively may assume at least one of a catalyst combustion mode, a gas-phase combustion mode and a concurrent combustion mode. In the catalytic combustion mode, the oxidation catalyst performs a catalytic function to cause combustion on the surface portion of the combustion member. In the gas-phase combustion mode, combustion occurs above the catalytic combustion element. In the concurrent combustion mode, the catalytic combustion mode and the gas-phase combustion mode occur concurrently.

According to a third aspect of the present invention, there is provided a method of causing catalytic combustion including the steps of preparing a combustion member made of a material high in thermal conductivity and having an oxidation catalyst carried thereon, causing air-fuel mixture to pass through the combustion member, igniting the air-fuel mixture to cause gas-phase combustion, and holding flames generated in gas-phase combustion on the combustion member to heat the oxidation catalyst to a catalytic activation temperature so that the catalytic combustion is started.

According to a fourth aspect of the present invention, the combustion member may be heated using heat generated by catalytic combustion.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENT

Figure 1:
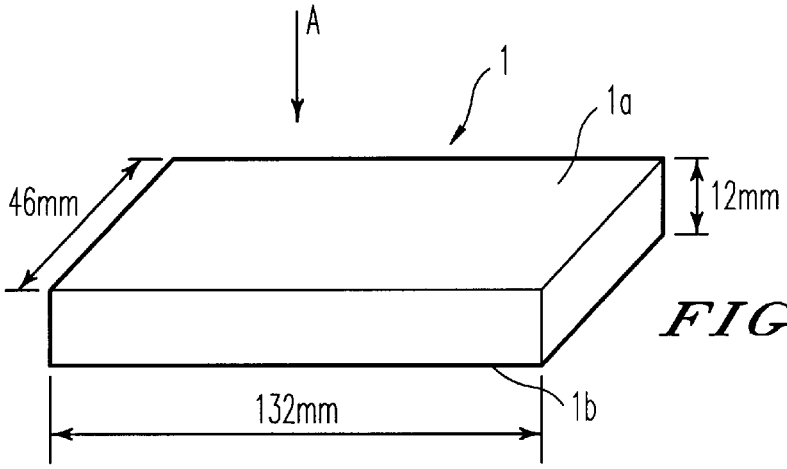
FIG. 1 is a perspective view of a catalytic screen burner according to an embodiment of the present invention.
Figure 2:
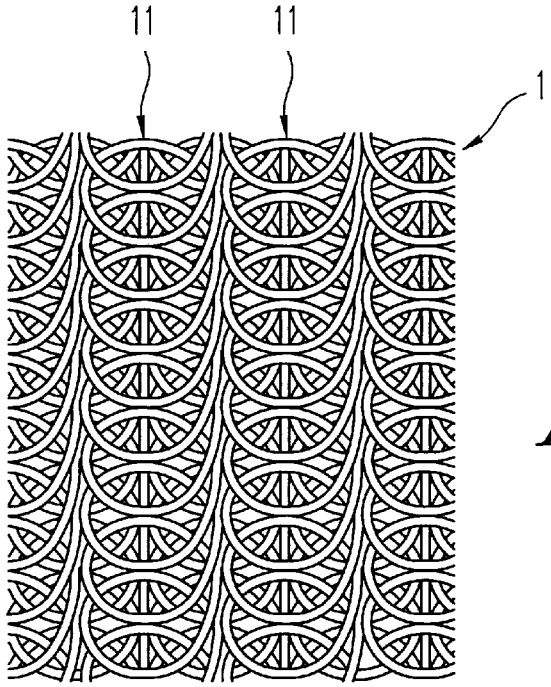
FIG. 2 is a partially enlarged view of the catalytic screen burner of FIG. 1, viewed from above in the direction of arrow A.

Referring now to the drawings, wherein like reference numerals designate identical or corresponding parts throughout the several views, and more particularly to FIG. 1 thereof, a combustion member 1 includes a front surface portion 1*a* and a rear surface portion 1*b*, the surface portions facing each other. The combustion member 1 is a rectangular parallel piped, which, in this embodiment, is 132 mm long, 46 mm wide and 12 mm thick. Referring to FIG. 2, it is seen that the combustion member 1 is formed by a plurality of ceramic wires 11, which are wound into loops stretched in a plane by offsetting the loop centers from each other, superimposed in the vertical direction, and then compressed. The combustion member 1 may be that having the trade name Actothermic®, which is made by Kobe Steel Works, Ltd. of Japan.

Figure 3:
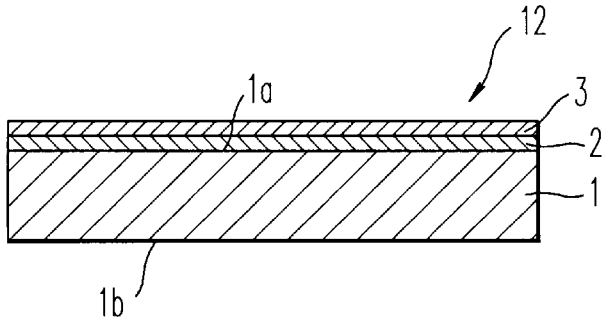
FIG. 3 is a side view of the catalytic screen burner according to the embodiment of the present invention.

The combustion member 1 is made of a ceramic material including 70% of SiC, which is high in thermal conductivity. As shown in FIG. 3, a front surface portion 1*a* of the combustion member 1 is coated with a γ-alumina ($Al_2O_3$) layer 2, which serves as a catalyst support. The catalyst support of γ-alumina layer 2 carries a palladium catalyst 3 on an outer surface thereof. The palladium catalyst is an oxidation catalyst for promoting combustion. The γ-alumina layer 2 allows the palladium catalyst 3 to be coated uniformly and the specific surface area thereof to be increased. The combustion member 1, the γ-alumina layer 2 and the palladium catalyst 3 together constitute a catalytic combustion element 12.

Figure 4:
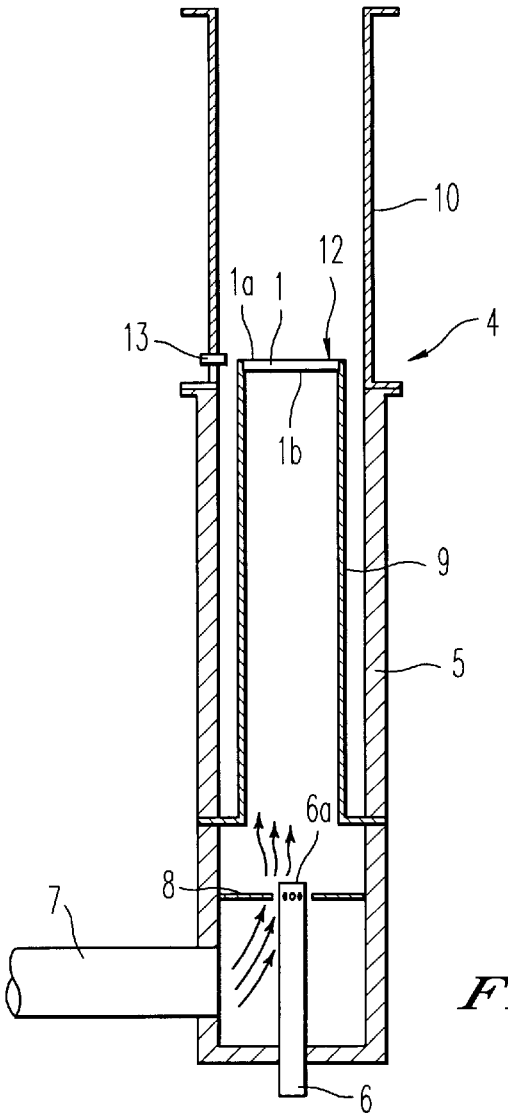
FIG. 4 is a partial sectional view of a combustion cylinder according to the embodiment of the present invention.

FIG. 4 shows a combustion cylinder 4 as a testing device for examining the performance of the catalytic combustion element 12. The combustion cylinder 4 is mainly composed of an adiabatic cylinder 5. A fuel supply tube 6 extends through the bottom of the combustion cylinder 4 and is designed to supply fuel into the combustion cylinder 4 from a fuel supply source (not shown). Also, an air supply tube 7 which is designed to supply air into the combustion cylinder 4 is connected to the side thereof. An annular plate 8 is fitted in the combustion cylinder 4 and arranged such that a fuel injection hole 6*a* of the fuel supply tube 6 extends through the center of the plate 8. The plate 8 promotes the mixing of air with fuel. Furthermore, the combustion cylinder 4 has therein a cylindrical casing 9 which has an enlarged flange portion at the bottom thereof The flange portion of the casing 9 is supported by the side of the combustion cylinder 4 and thereby held in position. The catalytic combustion element 12 as shown in FIGS. 1, 2 and 3 is mounted at the top of the casing 9. On the surface portion 1*a* of the combustion member 1 there is carried the palladium catalyst for causing catalytic combustion. A quartz glass cylinder 10 is mounted on the adiabatic cylinder 5, both cylinders 10 and 5 having the same diameter. An ignitor 13, which forms part of an ignition unit, is mounted through the side of the quartz glass cylinder 10 in the vicinity of the catalytic combustion element 12.

In operation, the combustion cylinder 4 is first supplied with air through the air supply tube 7, and then supplied with fuel through the fuel supply tube 6. The air supplied through the air supply tube 7 passes through a gap between the file supply tube 6 and the plate 8 and moves upward as indicated by arrows in FIG. 4. The air passing through the gap has such a large flow rate that there is generated a negative pressure in the vicinity of the fuel injection holes 6*a* of the fuel supply tube 6, which allows fuel to be injected through the fuel injection holes 6*a* more easily, thus prompting the process of mixing fuel with air. The air-fuel mixture thus obtained thus enters the quartz glass cylinder 10 through the catalytic combustion element 12 by passing the wires 11 of the member 1. Then the ignitor 13 ignites the air-fuel mixture to cause it to burn.

In the initial stage of combustion, the air-fuel mixture present in a gas phase burns and generates flames on the front surface portion 1*a*. The flames thus generated raise the temperature of the combustion member 1. When the temperature of the surface portion 1*a* reaches about 400° C., the palladium catalyst 3 carried on the combustion member 1 reaches a catalytic activation temperature. Then the palladium catalyst 3 operates such that catalytic combustion will occur in the catalytic combustion element 12. In this manner, a switch-over operation is performed from gas-phase combustion to catalytic combustion. Since catalytic combustion does not generate flames, an object to be heated can be disposed in the vicinity of the catalytic combustion element 12 to realize effective use of heat radiation. This achieves a substantial reduction in fuel consumption as well as in the overall dimensions.

Furthermore, by increasing the flow rate of the air-fuel mixture, gas-phase combustion can be started above the catalytic combustion element 12 while catalytic combustion still occurs. In this case, by causing catalytic combustion and gas-phase combustion to occur concurrently, high outputs can be obtained.

If the excess air factor is set to about 3 or the flow rate of air-fuel mixture is further increased, the flames generated in gas-phase combustion are further increased, the flames generated in gas-phase combustion are further lengthened, thus decreasing the temperature of the surface portion 1*a* of the combustion member 1. At this time, catalytic combustion is far less likely to occur than gas-phase combustion and, in fact, only the gas-phase combustion was observed.

Figure 6:
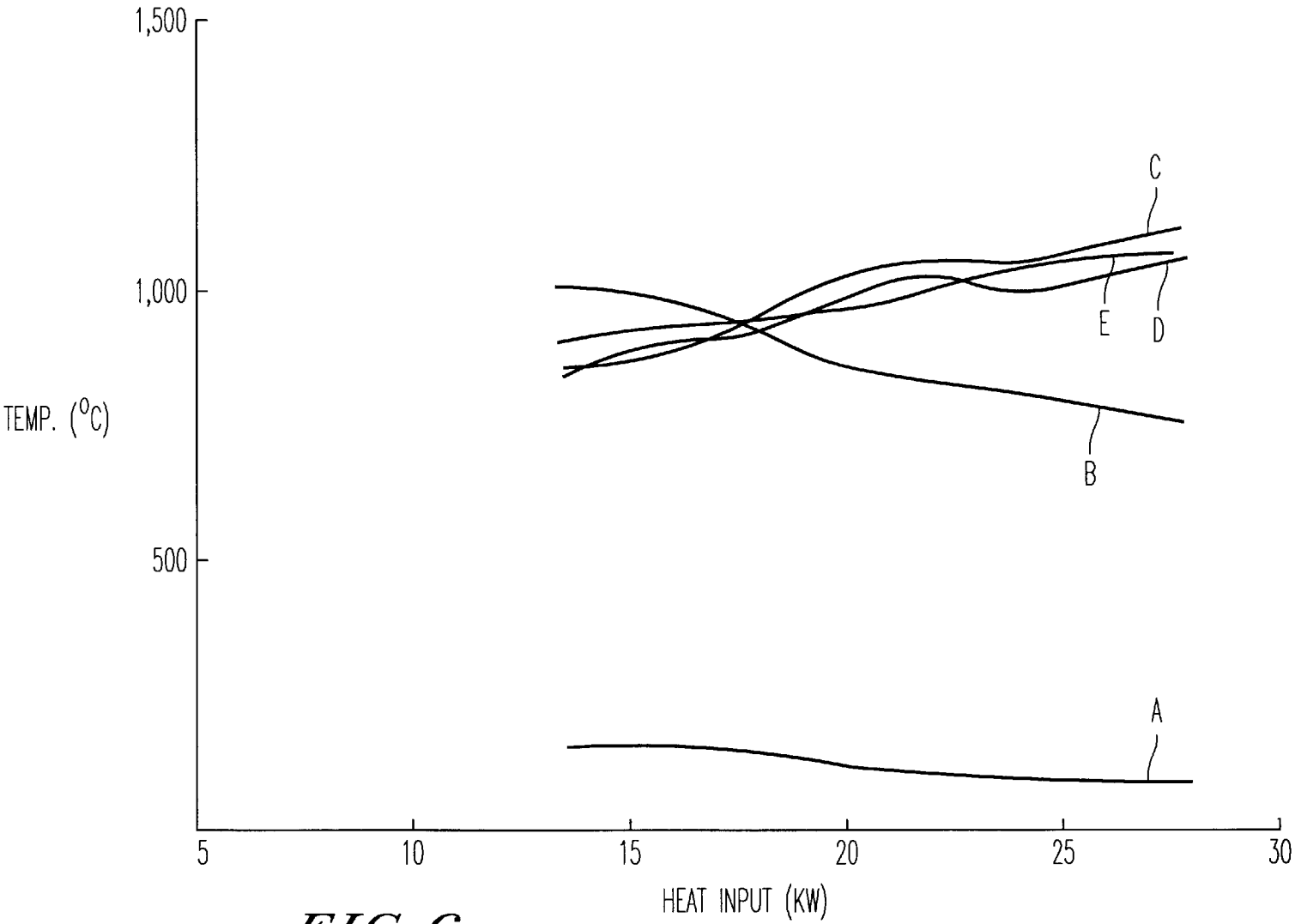
FIG. 6 is a graph showing the relation between thermal input and temperature of the respective portions relating to the combustion cylinder as shown in FIG. 4.
Figure 8:
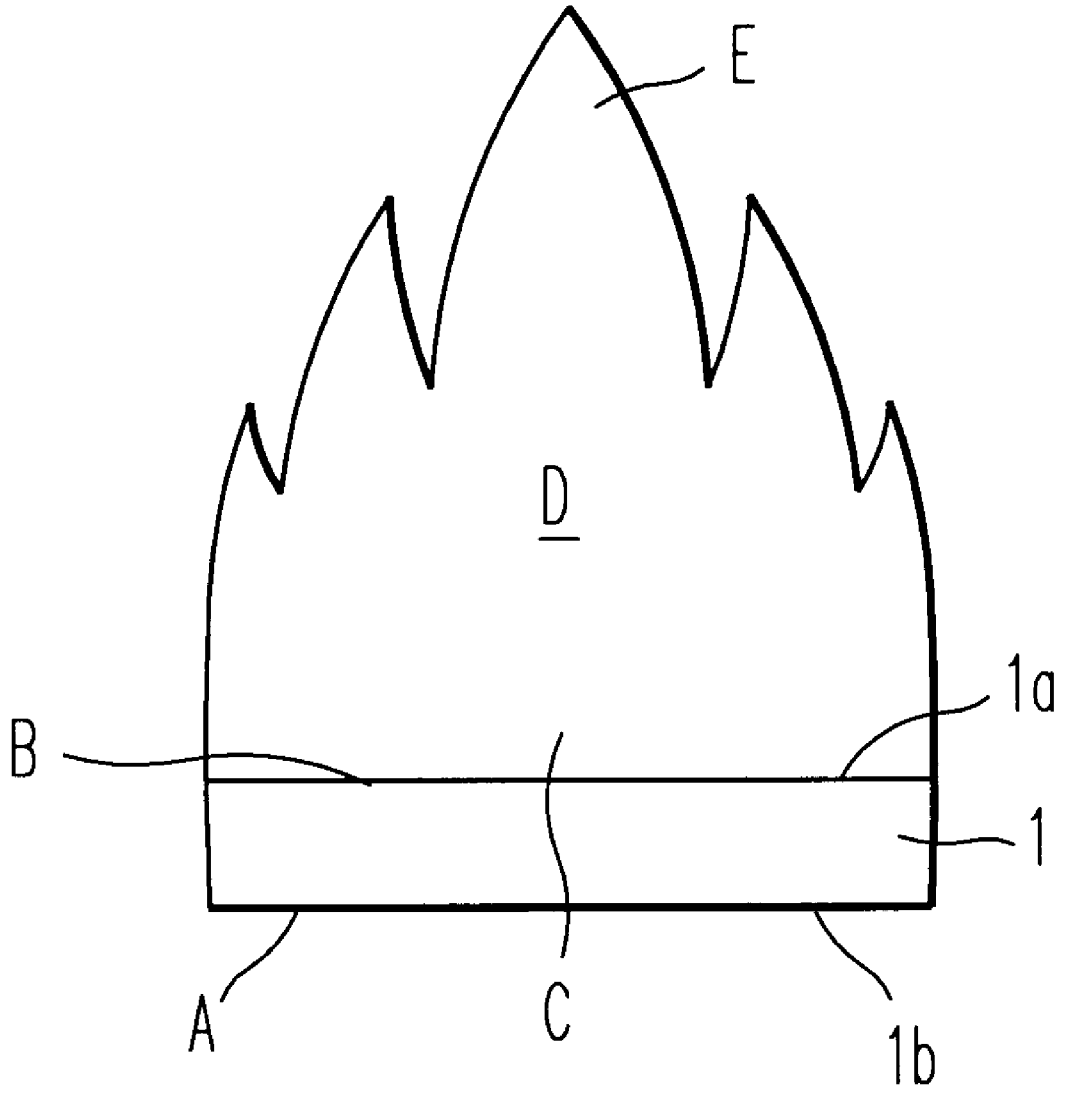
FIG. 8 is a diagram showing temperature measuring points of the respective portions of FIGS. 6 and 7.
Figure 9:
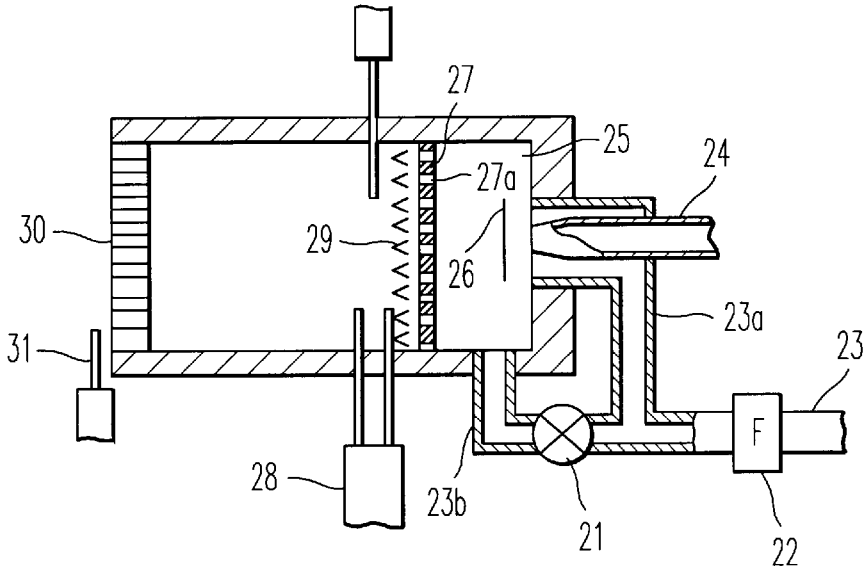
FIG. 9 PRIOR ART
FIG. 9 is a diagram showing a conventionally employed combustion apparatus.
Figure 10:
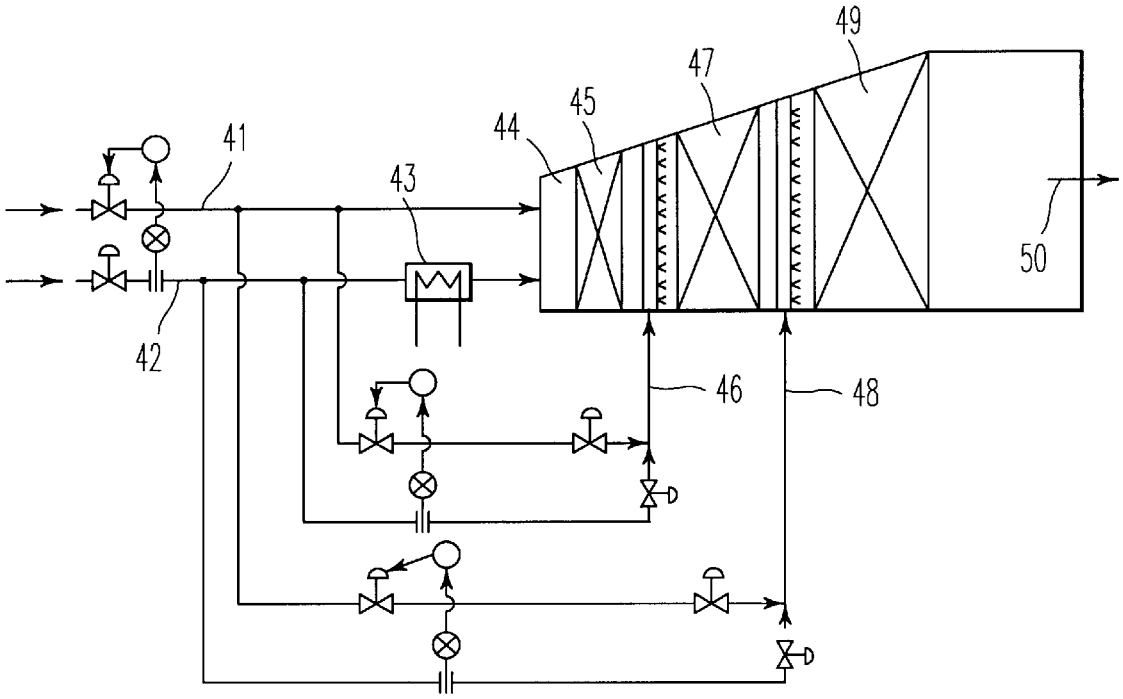
FIG. 10 PRIOR ART
FIG. 10 is a diagram showing another conventionally employed combustion apparatus.
Figure 11:
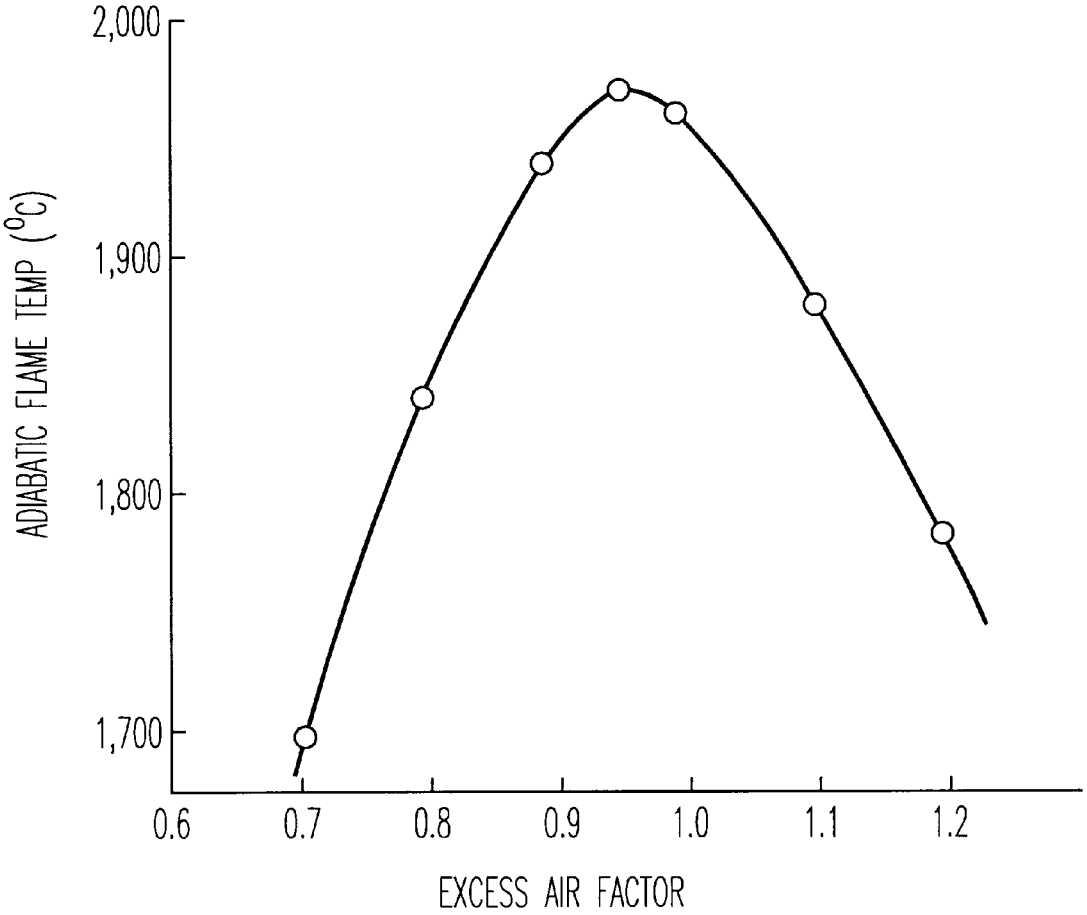
FIG. 11 is a graph showing the relation between excess air factor and adiabatic flame temperature.

Referring to FIG. 6, curve A indicates the temperature of the reverse surface portion 1*b* of the combustion member 1, curve B the temperature of the front surface portion 1*a* of the combustion member 1, curve C the temperature of the lower part of a flame generated in gas-phase combustion, curve D the temperature of the intermediate part of the flame and curve E the temperature of the upper part of the flame. These temperature measuring points are shown schematically in FIG. 8. As indicated by curve B in FIG. 6, the surface temperature of the catalytic combustion element 12, that is, the temperature of the front surface portion 1*a* of the combustion member 1, is substantially equal to that of a flame generated in gas-phase combustion. Thus, the front surface portion 1 a can be maintained at a temperature not lower than 700° C. even when thermal inputs are increased. This is because in addition to gas-phase combustion, catalytic combustion occurs efficiently. The heat generated in catalytic combustion is transmitted to the catalytic combustion element 12, thereby raising the temperature thereof.

Figure 7:
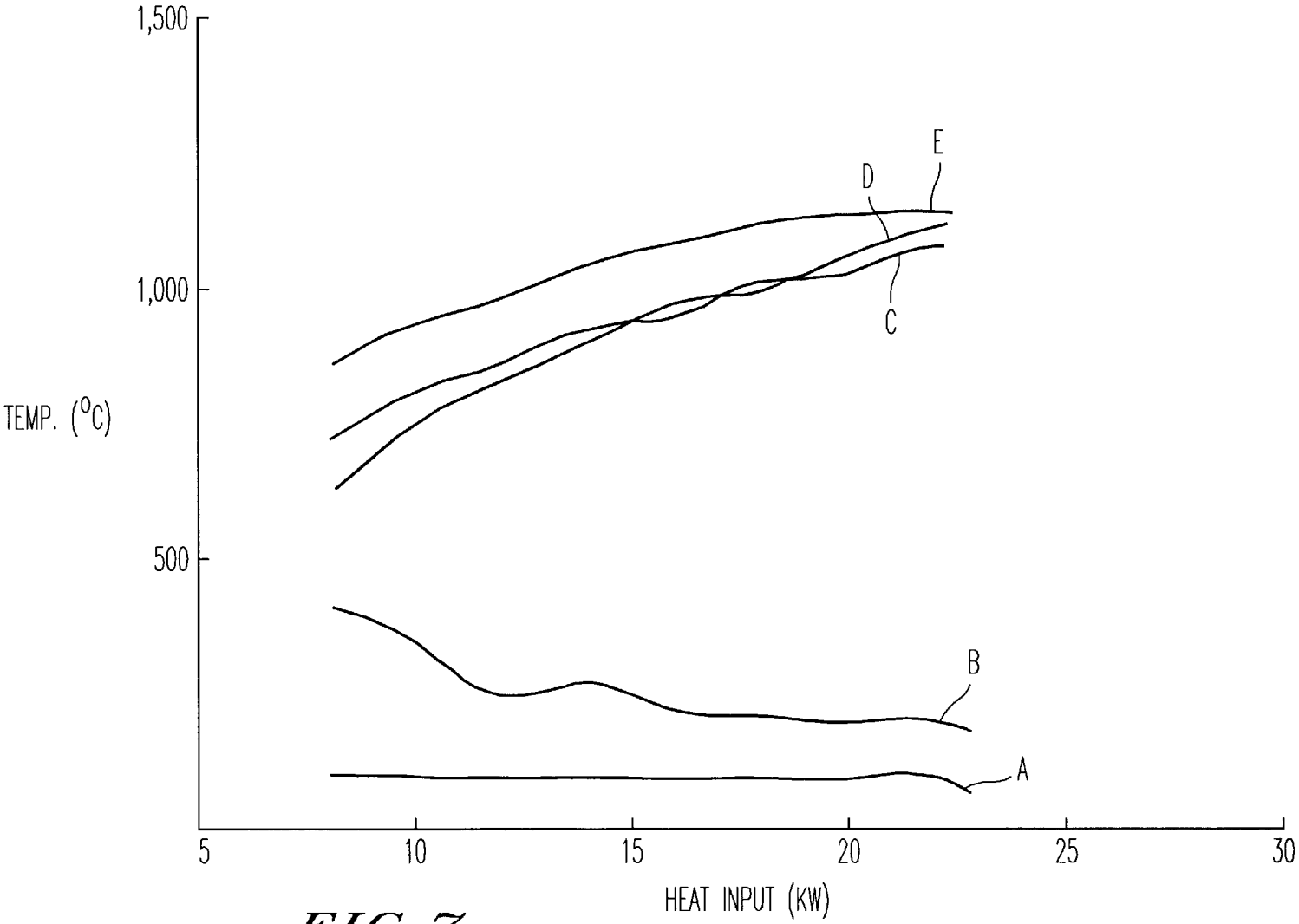
FIG. 7 is a graph showing the relation between thermal input and temperature of the respective portions relating to the combustion cylinder as shown in FIG. 4, with no oxidation catalyst being carried.

For the purpose of comparison, a similar test was conducted for a catalytic combustion element that does not have any catalyst carried thereon. The test result as shown in FIG. 7 indicates that the surface temperature of this element was considerably lower. It can be concluded, therefore, that the catalytic combustion element of this embodiment causes gas-phase combustion and catalytic combustion to occur concurrently and efficiently.

Furthermore, a similar test was conducted with an excess air factor of 1.2. Judging from this measurement results shown in FIG. 6, it was understood that the catalytic combustion element 12 was kept at a temperature ranging from 800 to 1000° C. without being heated excessively. This is because the catalytic combustion element 12 includes a large amount of SiC, whose thermal conductivity is high enough to allow heat to be externally dissipated rapidly. The heat thus dissipated is transmitted to the air-fuel mixture passing through the catalytic combustion element 12, and then to the object to be heated. This achieves a substantial reduction in fuel consumption, and hence in the cost of causing combustion.

Figure 5:
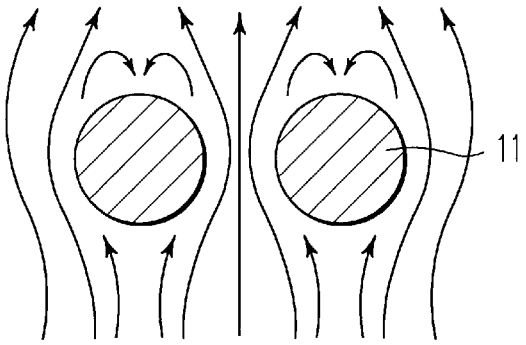
FIG. 5 is a diagram showing the flow of air-fuel mixture passing through the catalytic screen burner according to the embodiment of the present invention.

The combustion member 1 is composed of a plurality of ceramic wires 11 that are wound into loops. In this embodiment, the ceramic wires 11 serve as flame-holding means. As shown in FIG. 5, in the process of causing the air-fuel mixture to pass through the ceramic wires 11, the air-fuel mixture collides with the ceramic wires 11, and is dispersed in a plurality of directions, thus causing a swirl. This swirl causes the air-fuel mixture to flow backward, thereby agitating the flow of the air-fuel mixture. Since the flow rate of the air-fuel mixture flowing in the direction from the rear surface portion 1*b* to the front surface portion 1*a* is reduced, flames generated in gas-phase combustion are held on the front surface portion 1*a* without being blown off. This, in turn, promotes catalytic combustion by the catalyst 3 carried on the front surface portion 1*a* of the combustion member 1. Once catalytic combustion has been started, the flame-holding function is accomplished by the geometry of the combustion member 1 as well as by catalytic combustion itself. Accordingly, the flames are held securely without being blown off easily, even if the amount of fuel supplied is substantially increased. Thus, high outputs can be obtained.

According to the above described embodiment, the flames held by the flame-holding means activate the oxidation catalyst, thus starting catalytic combustion. Since the combustion member is higher in thermal conductivity than alumina, it is possible to prevent excessive accumulation of heat in the catalytic combustion element, hence overheating of the combustion member can be prevented. In this case, it is preferable that the combustion member is made of a ceramic material including more than 70% SiC.

Further, the catalytic combustion element can also be used as a gas-phase combustor by increasing the excess air factor of the air-fuel mixture passing through the catalytic combustion element and setting the flow rate of the air-fuel mixture to a relatively large value. In this case, catalytic combustion is far less likely to occur than gas-phase combustion and, in fact, what was observed was only gas-phase combustion. Then, by setting the excess air factor to about unity and decreasing the flow rate of the air-fuel mixture to a relatively small value, it is possible to substantially switch over from gas-phase combustion to catalytic combustion. In this case, the catalytic combustion element can be used exclusively as a catalytic combustor. Furthermore, by setting the excess air factor of the air-fuel mixture to about unity and increasing the air flow rate of the air-fuel mixture, the concurrent combustion mode may be created. In short, the catalytic combustion element of the present embodiment is able to assume any combustion mode.

Furthermore, upon the start of the catalytic combustion, heat is generated, transmitted to the combustion member of high thermal conductivity and dissipated outside. Accordingly, excessive heat is not accumulated in the combustion member, so that the catalytic combustion element is prevented from reaching an unacceptably high temperature. Consequently, the catalytic combustion element can operate even if the excess air rate is set to about unity. Furthermore, since the flames generated in gas-phase combustion produce heat to promote catalytic combustion, there is no need to provide another heater exclusively used for catalytic combustion.

Furthermore, the air-fuel mixture passing through the combustion member is also heated. In this manner, even if heat is dissipated from the catalytic combustion element, the heat can be used effectively, thus reducing the amount of fuel required to heat an object to be heated.

Obviously, numerous modifications and variations of the present invention are possible in light of the above teachings. It is therefore to be understood that within the scope of the appended claims, the invention may be practiced otherwise than as specifically described herein.

What is claimed as new and is desired to be secured by Letters Patent of the United States is:

1. A catalytic combustion element comprising:

a combustion member having front and rear surface portions and made of a material higher in thermal conductivity than alumina, said combustion member including flame-holding mechanism and having an oxidation catalyst carried at least on said front surface portion, wherein said combustion member allows air-fuel mixture to pass from said rear surface portion to said front surface portion so that the air-fuel mixture can burn on said front surface portion, and wherein said flame holding mechanism is geometrically configured such that the air-fuel mixture collides with the flame-holding mechanism and causing a swirling flow of such mixture such that flames formed on said front surface portion of said combustion member are held thereon, and wherein said flame-holding mechanism and said front surface portion on which said oxidation catalysts is carried are integrally formed as a single body with said combustion member and surface portion unit.

2. The catalytic combustion element according to claim 1, wherein said combustion member comprises a ceramic material including more than 70% of SiC.

3. A catalytic combustion element according to claim 1, wherein said catalytic combustion element is constructed so as to be able to undergo combustion modes selected from the group consisting of:

(a) a catalytic combustion mode in which said oxidation catalyst performs catalytic function to cause combustion on front surface portion of said combustion member, (b) a gas-phase combustion mode in which combustion occurs above said catalytic combustion element, and (c) a concurrent combustion mode in which said catalytic combustion mode and said gas-phase combustion mode are realized concurrently.

4. A catalytic combustion element according to claim 1, wherein said front surface portion comprises said flame-holding mechanism such that said oxidation catalyst is carried on a part of said flame-holding mechanism.

5. A catalytic combustion element comprising:

a combustion member having front and rear surface portions and made of a material higher in thermal conductivity than alumina said combustion member including flame-holding means and having an oxidation catalyst carried at least on said front surface portion, wherein said combustion member allows air-fuel mixture to pass from said rear surface portion to said front surface portion so that the air-fuel mixture can burn on said front surface portion, and wherein said flame holding means is geometrically configured such that the air-fuel mixture collides with the flame holding means causing a swirling flow of such mixture such that flames formed on said front surface portion of said combustion member are held thereon wherein said flame holding means comprise a plurality of ceramic wires wound into loops, and each ceramic wire is stretched in a plane by offsetting the loop centers thereof.

6. A catalytic combustion element, comprising:

a combustion member having front and rear surface portions and made of a material higher in thermal conductivity than alumina said combustion member including flame-holding mechanism and having an oxidation catalyst carried at least on said front surface portion, wherein said combustion member allows air-fuel mixture to pass from said rear surface portion to said front surface portion so that the air-fuel mixture can burn on said front surface portion, and wherein said flame holding means is geometrically configured such that the air-fuel mixture collides with the flame holding mechanism and causes a swirling flow of such mixture such that flames formed on said front surface portion of said combustion member are held thereon wherein said flame-holding mechanism is geometrically configured such that flames formed on said front surface portion of said combustion member are held thereon and wherein said flame-holding mechanism comprise a plurality of ceramic wires wound into loops, and wherein each ceramic wire is stretched in a plane by offsetting the loop centers thereof.

* * * * *